US010401132B1

(12) United States Patent
Spadoni

(10) Patent No.: US 10,401,132 B1
(45) Date of Patent: Sep. 3, 2019

(54) TARGET FOR SKEET SHOOTING

(71) Applicant: Vittorio Spadoni, Negrar (IT)

(72) Inventor: Vittorio Spadoni, Negrar (IT)

( * ) Notice: Subject to any disclaimer, the term of this patent is extended or adjusted under 35 U.S.C. 154(b) by 0 days.

(21) Appl. No.: 16/190,482

(22) Filed: Nov. 14, 2018

(51) Int. Cl.
*F41J 9/16* (2006.01)
*F41J 9/18* (2006.01)

(52) U.S. Cl.
CPC ... *F41J 9/16* (2013.01); *F41J 9/18* (2013.01)

(58) Field of Classification Search
CPC ..... F41J 9/16; F41J 9/18
USPC ..... 273/362–365
See application file for complete search history.

(56) References Cited

U.S. PATENT DOCUMENTS 152,101 A * 6/1874 Glahn ..... F41J 9/16 273/365
220,254 A * 10/1879 Redmond ..... F41J 1/01 273/362
299,835 A * 6/1884 Moyer ..... F41J 1/01 273/362
303,885 A 8/1884 Ridge
1,857,701 A * 5/1932 Warren ..... F41J 9/16 273/364
2,630,321 A * 3/1953 Clyne ..... F41J 9/08 273/362
2,835,073 A * 5/1958 Dame ..... A63H 33/18 244/12.2
3,411,778 A * 11/1968 Barry ..... A63H 27/10 273/363
3,758,985 A * 9/1973 Heisler ..... A63H 33/18 273/362
4,133,532 A * 1/1979 Lante-Montefeltro Della Rovere ..... F41J 9/16 273/364
4,206,919 A * 6/1980 Della Rovere ..... F41J 9/16 273/364
4,218,061 A * 8/1980 Lante-Montefeltro Della Rovere ..... F41J 9/16 273/364
4,274,636 A * 6/1981 Lante-Montefeltro .... F41J 9/32 273/365
4,433,842 A * 2/1984 Bertini ..... F41J 9/16 273/363
5,045,011 A 9/1991 Lovik
5,181,724 A * 1/1993 Spadoni ..... F41J 9/165 273/127 A
5,575,479 A * 11/1996 Ayres ..... F41J 9/165 273/363
2004/0155408 A1* 8/2004 Ringtved ..... F41J 9/16 273/362

FOREIGN PATENT DOCUMENTS

EP 0549841 A1 7/1993
WO 0227261 A1 4/2002

* cited by examiner

*Primary Examiner* — Mark S Graham
(74) *Attorney, Agent, or Firm* — Cantor Colburn LLP

(57) ABSTRACT

A target for skeet shooting which comprises a hub associated with a rotor that has at least two blades. The hub is associated with an elastic membrane, which in turn is associated with a valve and is designed to be inflated, in order to obtain a substantially spherical surface, before launching the target. Each blade extends longitudinally in a substantially crescent shape and has a geometric keying angle that is variable as a function of the rotation speed of the rotor about its own axis.

6 Claims, 3 Drawing Sheets

TARGET FOR SKEET SHOOTING

The present invention relates to a target for skeet shooting.

In particular, the present invention relates to a moving target for skeet shooting which flies away from the ground with a random and unpredictable motion, simulating the flight of a fleeing bird.

Moving targets, also known as clay pigeons, are known and widely used, and are constituted by flat targets.

The use of clay pigeons has some drawbacks.

Firstly, it should be noted that the trajectories of the clay pigeons are always parabolic, even though the launch angle changes.

This eliminates any unpredictability and irregularities of the flight, rendering the activity effectively monotonous.

Furthermore, in order to achieve the breakage of the clay pigeon when it is hit, it is essential to use lead shot, which is difficult to recover and therefore potentially pollutant.

Moving targets have also been proposed which are coupled to a propeller.

When launched, such targets have a more irregular trajectory than clay pigeons.

It should be noted however that the propellers of such targets have a geometry that remains unchanged, and with a determined pitch, and therefore they are practically immune to other aerodynamic effects, like the Magnus effect which is observed when a sphere rotates in a fluid.

This entails a considerable reduction in the sudden changes of trajectory that can be obtained with a spherical target flying in the presence of gusts of wind.

Furthermore, the propellers have a considerable size and weight, with consequent increase in the costs of production, transport and storage.

The aim of the present invention is to provide a target for skeet shooting which is capable of improving the known art in one or more of the above mentioned aspects.

Within this aim, an object of the invention is to provide a target for skeet shooting that is very small in size and limited in weight, which, at the moment of launch, transforms into a sphere of dimensions sufficient to be visually perceived.

Another object of the invention is to make available a target for skeet shooting that has an extremely random and unpredictable trajectory, sensitive to even the least air turbulence.

Another object of the invention is to provide a target for skeet shooting that is highly reliable, easy to implement and has a low cost.

This aim and these and other objects which will become better apparent hereinafter are achieved by a target for skeet shooting according to claim 1, optionally provided with one or more of the characteristics of the dependent claims.

Further characteristics and advantages of the invention will become better apparent from the description of some preferred, but not exclusive, embodiments of the target for skeet shooting according to the invention, which are illustrated for the purposes of non-limiting example in the accompanying drawings wherein.

Figures 1, 2:
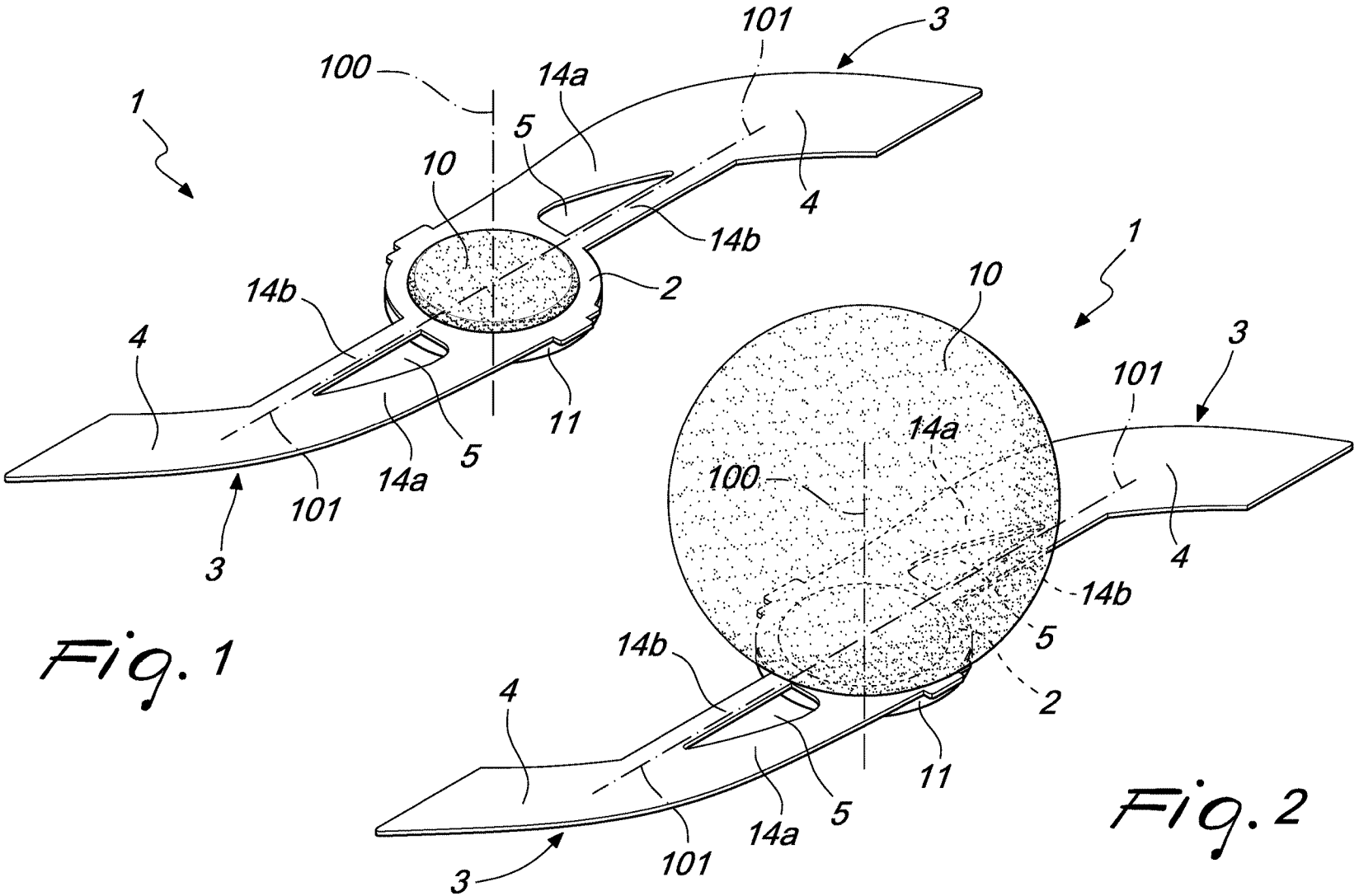
FIG. 1 is a perspective view of a target according to the invention with the membrane deflated.
FIG. 2 is a similar view to that in FIG. 1 with the membrane inflated.
Figures 3, 4, 5:
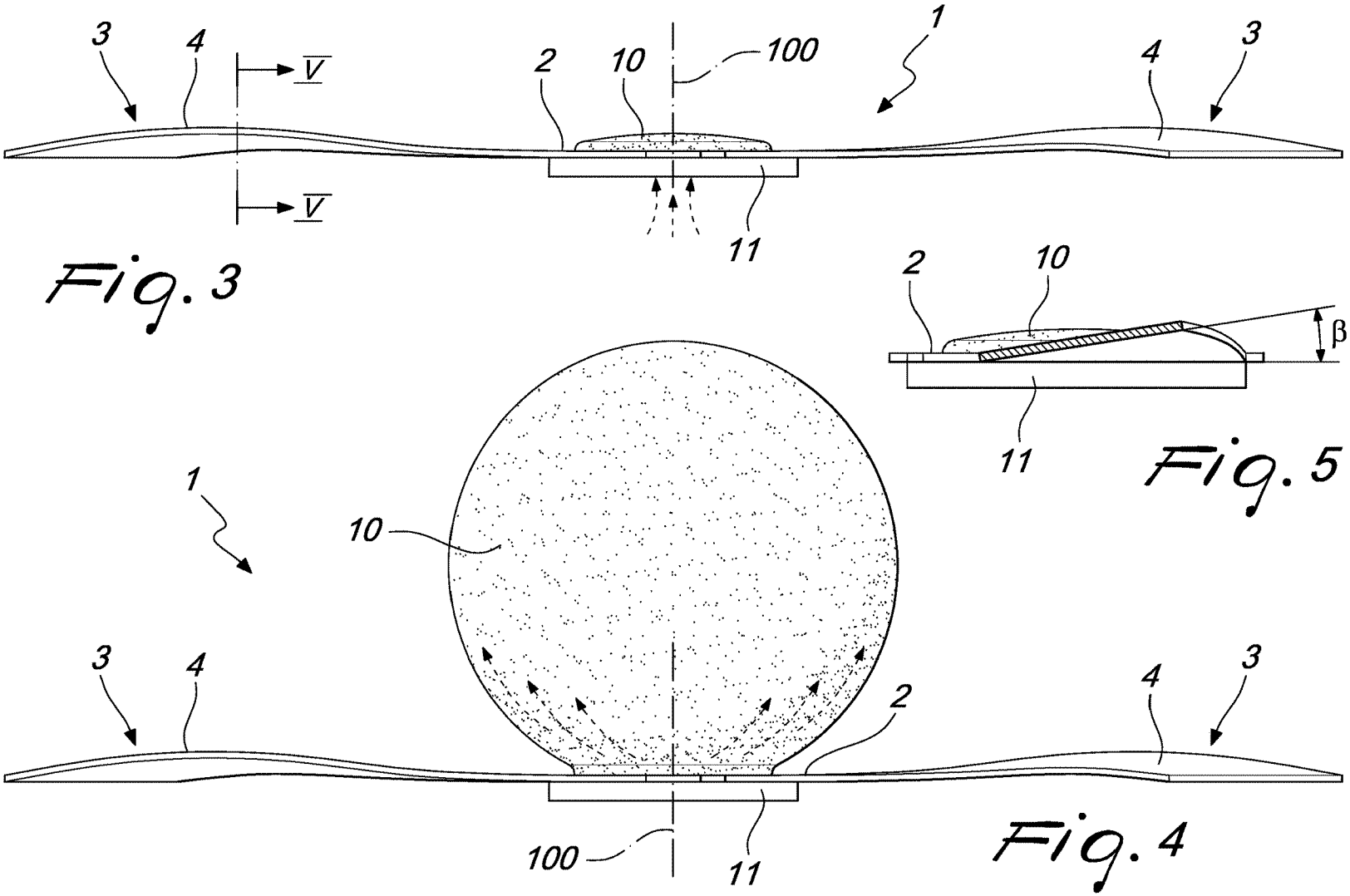
FIG. 3 is a side view of the target with the membrane deflated.
FIG. 4 is a side view of the target with the membrane inflated.
FIG. 5 is cross-sectional view of the blade of the target, taken along the line V-V in FIG. 3.
Figure 6:
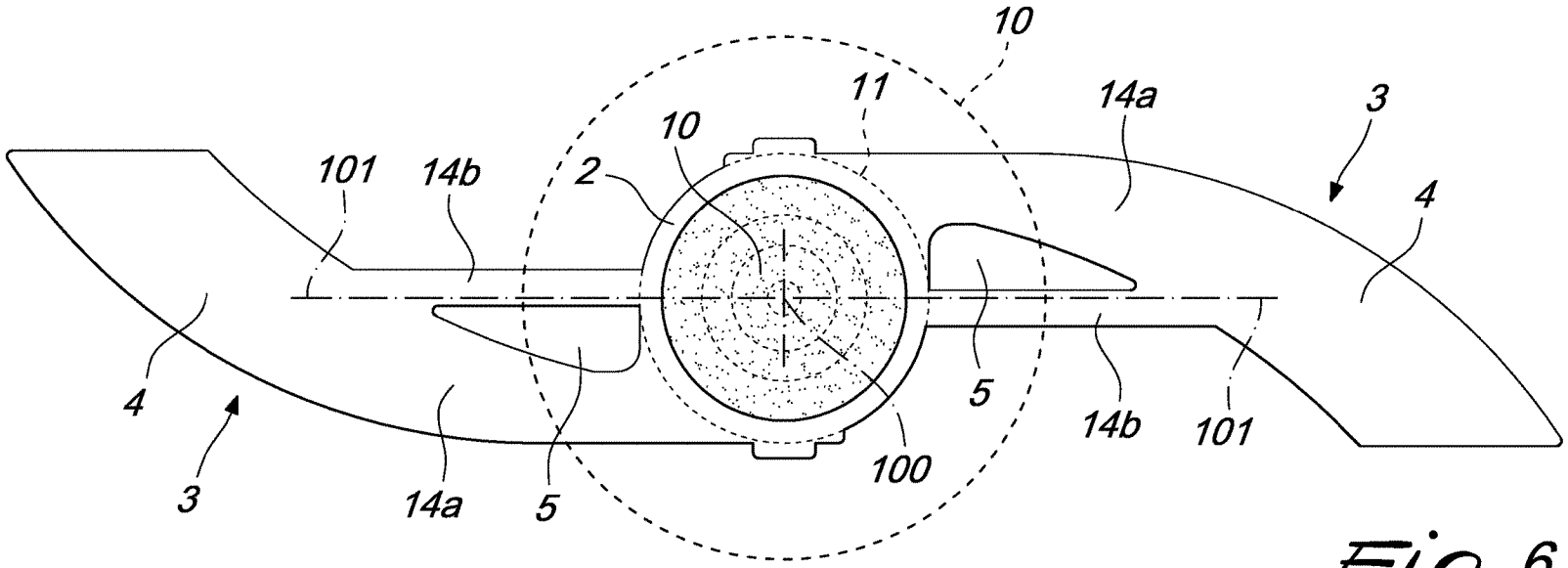
FIG. 6 is a view from above of the target.
Figure 7:
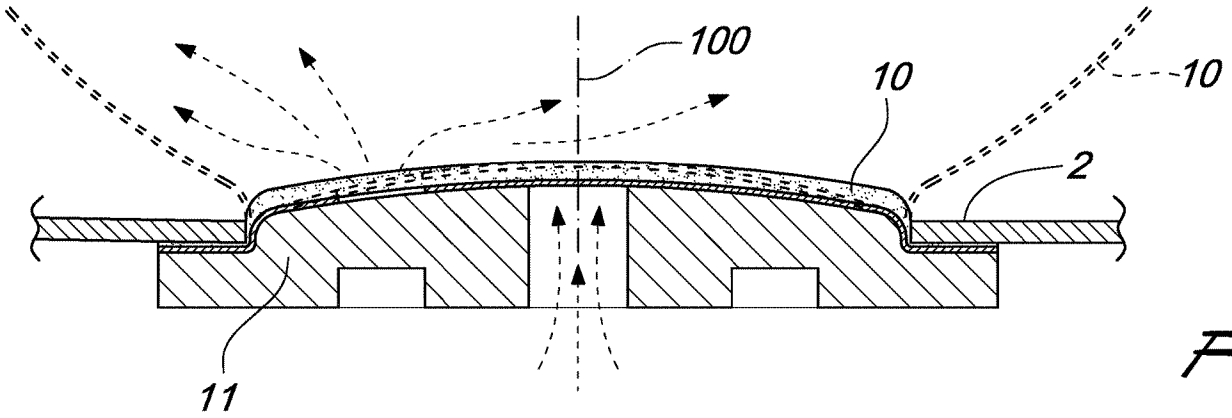
FIG. 7 is a diametrical cross-sectional view of the central part of the target.

With reference to the figures, the target for skeet shooting according to the invention, generally designated by the reference numeral 1, comprises a hub 2 which is associated with a rotor 3.

The rotor 3 has at least two blades 4.

Advantageously, the blades 4 are mutually spaced apart uniformly about the axis 100 of the rotor 3.

The hub 2 is associated with an elastic membrane 10 which is associated, in turn, with a valve 11.

The membrane 10 is designed to be inflated before launching the target 1 by way of conventional devices, such as for example a nozzle connected functionally to a tank containing compressed air.

As a consequence of such inflation, the membrane 10 forms a substantially spherical surface of such dimensions that it can be visually perceived.

According to the present invention, each blade 4 extends longitudinally in a crescent shape.

Each blade is further provided with a geometric keying angle, designated in the figures with the letter β, which is variable as a function of the rotation speed of the rotor 3 about the axis 100 of the rotor.

Preferably, the rotor 3 is made of a ferromagnetic material.

Conveniently, the at least two blades have a keying angle β that is variable along their longitudinal extension 101.

In particular, with reference to the embodiment shown in the figures, the keying angle β, from the hub 2 toward the free end 4*a* of the blade 4, at first increases and then decreases.

It has been found to be particularly convenient, from the manufacturing viewpoint as well, if the at least two blades comprise a lamina with a substantially constant thickness.

As shown in the figures, each blade 4 has at least one through opening 5 which defines, on opposite sides, a respective crescent-shaped front portion 14*a* and a respective linear rear portion 14*b* which provides a stiffening tension member.

The particular shape structure of the blades 4, and specifically the presence of the rear portion 14*b*, limits the angle of torsion of the respective crescent-shaped front portion 14*a* about the longitudinal axis 101 as a consequence of the action of centrifugal force, and therefore the variation of the pitch.

The particular shape of the blades 4, and in particular of the crescent-shaped front portion 14*a*, makes it possible to distribute the weight further away from the axis 100 of the rotor so as to optimize the effect of the centrifugal force, so as to deform the target 1.

Use of the target for skeet shooting 1, according to the invention, is the following.

The targets 1, with the membrane deflated, are stacked on a supporting and feeding structure associated with a launching device.

The launching device has a pickup body, for example associated with a rotating axis (kinematically connected to for example an electric or pneumatic motor) and interfering by friction with the hub 2 of the target 1, which is designed to pick up the target 1 to be launched and feed it to a launch station at which a device for inflating the membrane is operating.

At the launch station the rotor is made to rotate about the axis 100.

Once the rotor has reached the chosen speed, an electromagnet is activated in order to produce a thrust on the rotor, parallel to the rotation axis 100 and adapted to defeat the friction between the pickup body and the hub and to give the target a thrust component that heightens its parabola.

In practice it has been found that the invention fully achieves the intended aim and objects by providing a target 1 that offers an extremely varied and random flight.

Giving the blades a crescent-shaped shape structure ensures a boomerang effect, with the result that it ensures the target remains for longer within the field of fire.

The structure of the blades 4, which enables a variation of the geometric keying angle β as the rotation speed varies, further accentuates the unpredictability of the trajectories and movement of the target in flight.

In essence, the centrifugal force, which depends on the rotation speed, modifies the geometry of the blades 4, varying their pitch.

Furthermore, in low or skimming launches at high speed, the target gains elevation by virtue of the ground effect in that the target, with the maximum pitch, loses speed and, as the gyroscopic effect diminishes, is quickly brought to its natural position of equilibrium (i.e. on a substantially horizontal plane).

By contrast, in launches at low rotation speed and with a higher launch angle from the horizontal, the target maintains the minimum pitch of the blades, which enables a forward flight and an autorotation landing, with different effects from low launches at high speed.

Having the front portion 14*a* of the blades 4 extending in a crescent shape with the convexity directed toward the front further makes it possible to appreciably reduce the damage in the event of impact of the target against persons or property.

The target 1 can further be hit with iron shot and this evidently results in a lower environmental impact, which in turn facilitates the gathering of both discarded materials (the target and the shot) with a magnetic utensil.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A target for skeet shooting, comprising a hub which is associated with a rotor that has at least two blades, said hub being associated with an elastic membrane which is associated with a valve and is designed to be inflated before launching said target, wherein said at least two blades extend longitudinally in a substantially crescent shape and have a geometric keying angle that is variable as a function of the rotation speed of the rotor about the axis of the rotor.

2. The target for skeet shooting according to claim 1, wherein said rotor is made of a ferromagnetic material.

3. The target for skeet shooting according to claim 1, wherein said at least two blades have a keying angle that is variable along their longitudinal extension.

4. The target for skeet shooting according to claim 3, wherein the keying angle, from the hub toward the free end of the blade, at first increases and then decreases.

5. The target for skeet shooting according to claim 1, wherein said at least two blades comprise a lamina which has a substantially constant thickness.

6. The target for skeet shooting according to claim 1, wherein said at least two blades have at least one through opening which defines, on opposite sides, a respective crescent-shaped front portion and a respective linear rear portion which provides a stiffening tension member.

* * * * *